US009671720B2

(12) United States Patent
Asaka

(10) Patent No.: US 9,671,720 B2
(45) Date of Patent: Jun. 6, 2017

(54) IMAGE FORMING APPARATUS WITH DEVELOPING DEVICE FOR SUPPLYING TONER

(71) Applicant: KYOCERA Document Solutions Inc., Osaka (JP)

(72) Inventor: Hitoshi Asaka, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/189,800

(22) Filed: Jun. 22, 2016

(65) Prior Publication Data

US 2016/0378019 A1 Dec. 29, 2016

(30) Foreign Application Priority Data

Jun. 26, 2015 (JP) ..... 2015-128910

(51) Int. Cl.
*G03G 15/08* (2006.01)

(52) U.S. Cl.
CPC ..... *G03G 15/0831* (2013.01); *G03G 15/0891* (2013.01)

(58) Field of Classification Search
CPC ..... G03G 15/0831; G03G 15/0891
See application file for complete search history.

(56) References Cited

U.S. PATENT DOCUMENTS

2003/0021609 A1* 1/2003 Yamaguchi ..... G03G 15/0849 399/27
2005/0254832 A1* 11/2005 Kumai ..... G03G 15/0863 399/12
2011/0158669 A1* 6/2011 Kayahara ..... G03G 15/0877 399/53
2013/0223855 A1* 8/2013 Ajima ..... G03G 15/556 399/27

FOREIGN PATENT DOCUMENTS

JP 2000-338767 A 12/2000

* cited by examiner

*Primary Examiner* — Rodney Bonnette
(74) *Attorney, Agent, or Firm* — Stein IP, LLC

(57) ABSTRACT

When an image forming apparatus detects that an amount of toner returns to a first reference amount or more without replacement of a container after determining that a toner low state has occurred, the image forming apparatus controls a container memory unit to store predetermined information. When performing toner supply, if the predetermined information is stored, the image forming apparatus performs at least one of a first process for changing a time ratio so that a rotation period ratio of a supply screw is increased and a second process for changing the first reference amount to be increased.

5 Claims, 6 Drawing Sheets

IMAGE FORMING APPARATUS WITH DEVELOPING DEVICE FOR SUPPLYING TONER

INCORPORATION BY REFERENCE

This application is based upon and claims the benefit of priority from the corresponding Japanese Patent Application No. 2015-128910 filed Jun. 26, 2015, the entire contents of which are hereby incorporated by reference.

BACKGROUND

The present disclosure relates to an image forming apparatus having a developing device for developing an electrostatic latent image into a toner image.

Conventionally, there is known an image forming apparatus that develops an electrostatic latent image into a toner image and transfers (prints) the toner image onto a paper sheet. This image forming apparatus includes a developing device that supplies toner to the electrostatic latent image so as to develop the electrostatic latent image into a toner image.

The developing device stores toner inside, and the toner inside the developing device is consumed while printing is performed (an amount of toner in the developing device is decreased). Accordingly, the image forming apparatus having the developing device is usually equipped with a container (toner box) for storing supply toner. Furthermore, when toner supply to the developing device is necessary, the toner in the container is supplied to the developing device.

In addition, the developing device is equipped with a toner sensor. A supply screw (toner supply roller) is disposed between the container and the developing device. Furthermore, an amount of toner in the developing device is detected on the basis of an output value of the toner sensor. When an amount of toner in the developing device becomes less than an appropriate value, the supply screw is rotated so that the toner is dropped from the container to the developing device. In this way, the developing device is supplied with the toner.

SUMMARY

An image forming apparatus of the present disclosure includes a developing device, a container, a container memory unit, a supply screw, a notifying unit, a toner sensor, and a control unit. The developing device stores toner and supplies the toner to an electrostatic latent image formed on an image carrier so as to develop the electrostatic latent image into a toner image. The container is replaceable with respect to the image forming apparatus, and stores supply toner to be supplied to the developing device. The container memory unit is provided to the container, and stores container information including identification information and use history information of the container. The supply screw performs toner supply from the container to the developing device by rotating, and repeats rotation and stop at a predetermined time ratio while performing the toner supply. The notifying unit makes a replacement notification for urging a user to replace the container when a remaining amount state of toner in the container becomes a predetermined toner low state. The toner sensor detects an amount of toner in the developing device. The control unit detects an amount of toner in the developing device on the basis of an output value of the toner sensor, controls the supply screw to perform the toner supply when the amount of toner in the developing device becomes less than a predetermined first reference amount, stops the toner supply when the amount of toner in the developing device returns to the first reference amount or more, and determines that the toner low state has occurred so as to control the notifying unit to make the replacement notification when the amount of toner in the developing device does not return to the first reference amount or more but is less than a predetermined second reference amount after performing the toner supply. The control unit determines whether or not the container that was mounted in the image forming apparatus when the toner low state had occurred is replaced with another container on the basis of the container information after determining the toner low state had occurred, and controls the container memory unit to store predetermined information indicating that the toner low state is canceled when detecting that the amount of toner in the developing device has returned to the first reference amount or more without replacement of the container. The control unit performs at least one of a first process and a second process if the predetermined information is stored in the container memory unit of the container currently mounted in the image forming apparatus when performing the toner supply. The first process is a process of changing the time ratio so that a rotation period ratio of the supply screw becomes larger than that set when determining that the toner low state had occurred, and the second process being a process of changing the first reference amount so that the first reference amount becomes larger than that set when determining that the toner low state had occurred.

DETAILED DESCRIPTION

Structure of Image Forming Apparatus

Figure 1:
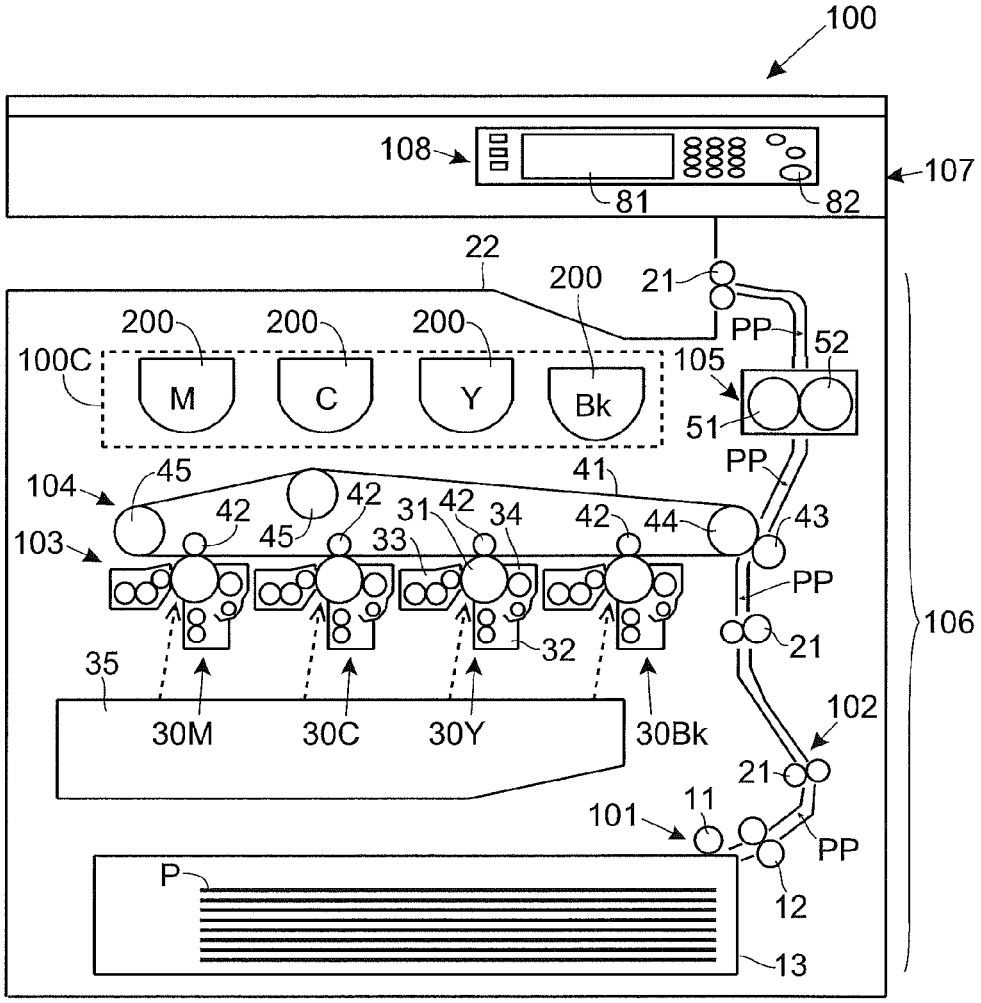
FIG. 1 is a schematic diagram of an image forming apparatus according to an embodiment of the present disclosure.

As illustrated in FIG. 1, an image forming apparatus 100 of this embodiment is equipped with a printing unit 106 including a sheet feeding unit 101, a sheet conveying unit 102, an image forming unit 103, an intermediate transfer unit 104, and a fixing unit 105. The printing unit 106 conveys a paper sheet P along a paper sheet conveying path PP and forms a toner image on the basis of image data of an image to be printed. Furthermore, the printing unit 106 prints (transfers) the toner image on the paper sheet P that is being conveyed. Further, the image data as a base of the toner image is image data obtained by reading a document by an image reading unit 107 described later, or image data transmitted from a user terminal 300 described later (see FIG. 3) to the image forming apparatus 100.

The sheet feeding unit 101 includes a pickup roller 11 and a sheet feed roller pair 12, and feeds the paper sheet P stored in a paper sheet cassette 13 to the paper sheet conveying path PP. The sheet conveying unit 102 includes a plurality of convey roller pairs 21, conveys a paper sheet P along the paper sheet conveying path PP, and discharges the paper sheet P to a discharge tray 22.

The image forming unit 103 includes a photosensitive drum 31 (corresponding to an "image carrier"), a charging device 32, a developing device 33, a cleaning device 34 and an exposing device 35. Note that the image forming unit 103 is divided into mechanical units 30Bk, 30Y, 30C and 30M corresponding respectively to black (Bk), yellow (Y), cyan (C) and magenta (M) colors. Furthermore, each of the mechanical units 30Bk, 30Y, 30C and 30M includes the photosensitive drum 31, the charging device 32, the developing device 33 and the cleaning device 34, so as to form the toner image of the corresponding color. The exposing device 35 is commonly used for the colors so as to form electrostatic latent images on outer peripheral surfaces of the photosensitive drums 31.

Here, the developing device 33 stores toner for development, and supplies the toner to the electrostatic latent image formed on the outer peripheral surface of the photosensitive drum 31, so as to develop the electrostatic latent image into a toner image. In this structure, an amount of toner in the developing device 33 is decreased while printing is performed, and therefore it is necessary to supply toner to the developing device 33. Accordingly, the image forming apparatus 100 is equipped with four containers 200 for respectively storing black (Bk), yellow (Y), cyan (C) and magenta (M) supply toner. Furthermore, when it is necessary to supply toner to the developing device 33, the toner in the container 200 is supplied to the developing device 33 (details will be described later).

The container 200 is replaceable (attachable and detachable) with respect to the image forming apparatus 100. For instance, a part of an outer cover of the image forming apparatus 100 is an openable and closable cover 100C. When the cover 100C is opened, a space for attaching the container 200 is exposed. In this way, if toner in the container 200 is run out, the container 200 can be replaced with a new container 200.

Figure 2:
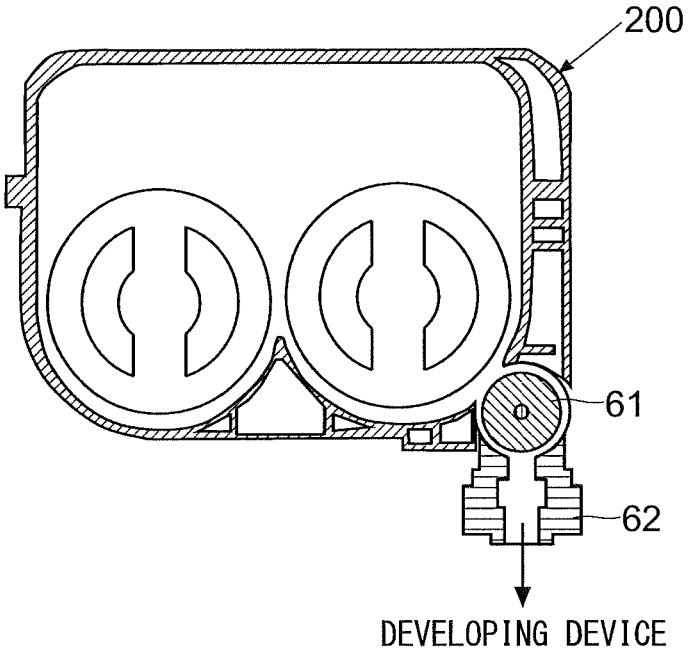
FIG. 2 is a diagram illustrating an example of a container mounted in the image forming apparatus according to an embodiment of the present disclosure.

A supply screw 61 is disposed as illustrated in FIG. 2 for toner supply from the container 200 to the developing device 33. The supply screw 61 may be attached to a main body of the image forming apparatus 100 or may be attached to the container 200. In addition, when the container 200 is attached to the image forming apparatus 100, the container 200 is connected with the developing device 33 via a supply pipe 62.

Figure 3:
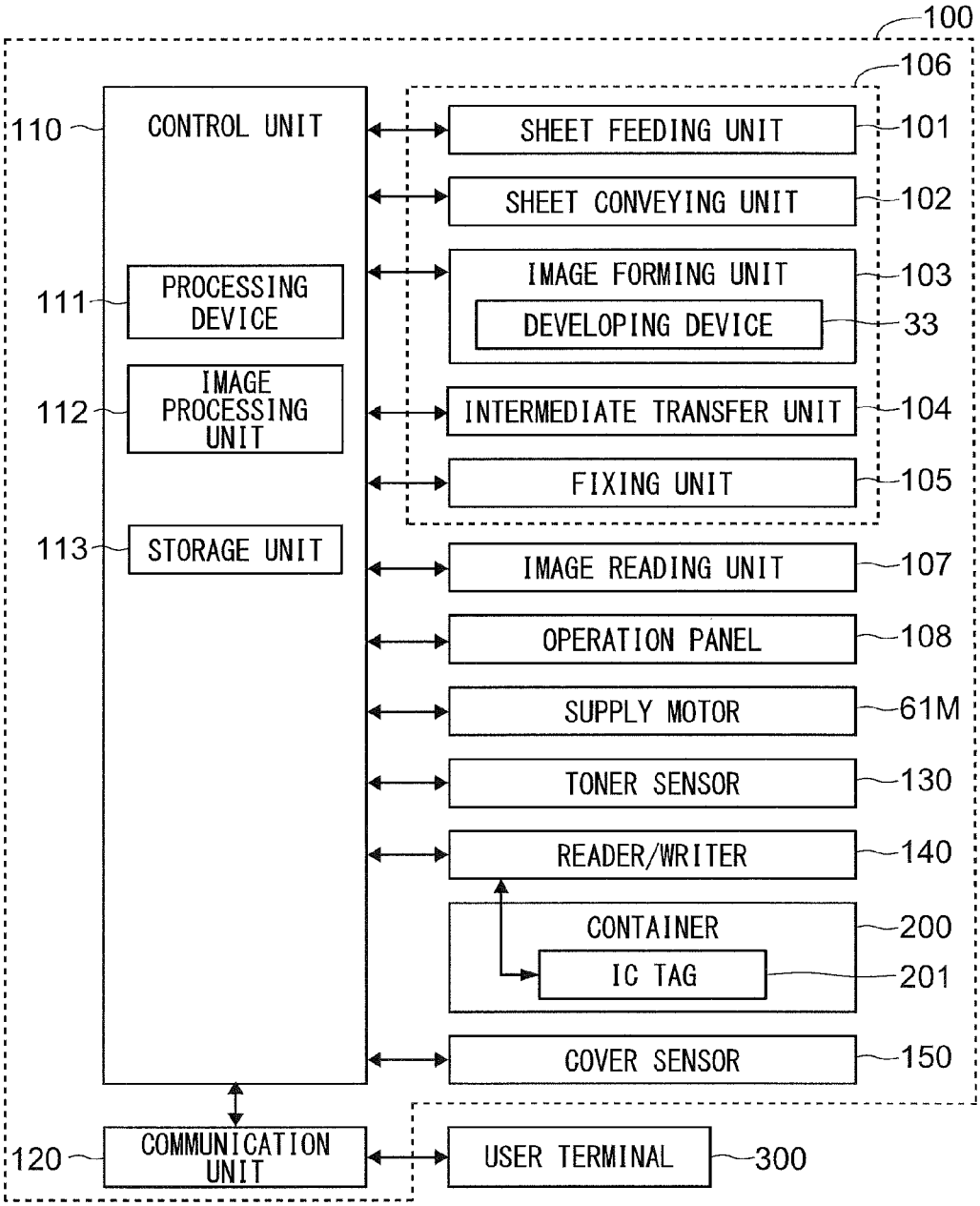
FIG. 3 is a block diagram illustrating an example of a hardware structure of the image forming apparatus according to an embodiment of the present disclosure.

For instance, the supply screw 61 has a structure in which an impeller is helically formed around a rotation shaft, and is rotated by a drive force transmitted from a supply motor 61M (see FIG. 3). In order to supply the toner from the container 200 to the developing device 33, the supply screw 61 is rotated so that the toner in the container 200 drops from the container 200. The toner dropping from the container 200 is supplied to the developing device 33 via the supply pipe 62.

With reference to FIG. 1 again, the intermediate transfer unit 104 includes an intermediate transfer belt 41, primary transfer rollers 42, and a secondary transfer roller 43. The intermediate transfer belt 41 is stretched around a drive roller 44 and a follower roller 45. The toner images of individual colors formed by the image forming unit 103 (toner images on the outer peripheral surfaces of the photosensitive drums 31) are primarily transferred onto the intermediate transfer belt 41. Then, the intermediate transfer unit 104 secondarily transfers the toner image on the intermediate transfer belt 41 onto the paper sheet P.

The fixing unit 105 includes a heating roller 51 and a pressure roller 52. When the paper sheet P enters a nip between the heating roller 51 and the pressure roller 52, the fixing unit 105 heats and presses the paper sheet P so that the toner image is fixed onto the paper sheet P.

In addition, the image forming apparatus 100 includes the image reading unit 107. The image reading unit 107 reads a document so as to generate image data. For instance, the printing unit 106 performs printing on the basis of the image data obtained by reading the document by the image reading unit 107.

In addition, the image forming apparatus 100 includes an operation panel 108. The operation panel 108 includes a liquid crystal display panel 81 with a touch panel. In addition, the operation panel 108 also includes hardware keys 82 such as a job start key and a ten key. Furthermore, the operation panel 108 receives various inputs such as setting of set values from users. In addition, the operation panel 180 displays messages for informing users about various notifications.

In addition, as illustrated in FIG. 3, the image forming apparatus 100 includes a control unit 110. This control unit 110 includes a process device 111, an image process unit 112, and a storage unit 113. The process device 111 is constituted of a processor such as a CPU or an MPU. The image process unit 112 is constituted of a dedicated circuit or an ASIC for image process, and performs various image process (such as scaling, density conversion, and data format conversion) on the image data. The storage unit 113 is constituted of a ROM, a RAM, an HDD, and the like, and stores control programs and data. Furthermore, the control unit 110 controls operations of individual units of the image forming apparatus 100 on the basis of the control programs and data stored in the storage unit 113.

Specifically, the control unit 110 is connected to the printing unit 106 (the sheet feeding unit 101, the sheet conveying unit 102, the image forming unit 103, the intermediate transfer unit 104, and the fixing unit 105) so as to control a printing operation of the printing unit 106. In addition, the control unit 110 is connected to the image reading unit 107 so as to control a reading operation of the image reading unit 107. Furthermore, the control unit 110 is connected to the operation panel 108 so as to control a display operation of the operation panel 108 and to detect an operation performed to the operation panel 108.

In addition, the control unit 110 is connected to a communication unit 120. This communication unit 120 is connected to the user terminal 300 in a communicable manner. Note that the user terminal 300 is used by a user, and is a laptop or desktop personal computer. For instance, the communication unit 120 receives image data (of a document generated by the user terminal 300), which is transmitted from the user terminal 300 to the image forming apparatus 100. When the communication unit 120 receives the image data, the control unit 110 controls the printing unit 106 to perform printing based on the image data.

In addition, the control unit 110 is connected to a toner sensor 130 for detecting amount of toner in the developing device 33. Although not a limitation, a magnetic sensor is used as the toner sensor 130.

The control unit 110 detects the amount of toner in the developing device 33 on the basis of an output value of the toner sensor 130. Further, when the amount of toner in the developing device 33 becomes smaller than a predetermined first reference amount (an appropriate amount), the control unit 110 determines that it is necessary to supply toner from the container 200 to the developing device 33. In other words, the control unit 110 determines whether or not it is necessary to supply toner to the developing device 33, on the basis of whether or not the output value of the toner sensor 130 is more than (or less than) a predetermined threshold value (corresponding to the first reference amount). As a result of this determination, when it is determined that the toner supply to the developing device 33 is necessary, the control unit 110 performs the toner supply to the developing device 33 so that the amount of toner in the developing device 33 returns to the first reference amount or more.

After the control unit 110 starts the toner supply to the developing device 33, when the amount of toner in the developing device 33 returns to the first reference amount or more, the control unit 110 stops the toner supply. Accordingly, the amount of toner stored in the developing device 33 is ideally maintained at the first reference amount.

In order to perform the toner supply to the developing device 33, the control unit 110 controls to drive the supply motor 61M. When the control unit 110 determines that the toner supply to the developing device 33 is necessary, the control unit 110 drives the supply motor 61M so as to rotate the supply screw 61. In this way, the toner in the container 200 drops to the developing device 33 (the toner in the container 200 is supplied to the developing device 33 via the supply pipe 62).

Note that the supply screw 61 drops a substantially fixed amount of toner per one rotation from the container 200 to the developing device 33. In other words, a target amount of a drop amount of toner per one rotation of the supply screw 61 (an amount of toner supplied to the developing device 33 when the supply screw 61 rotates one turn) is determined in advance, and a shape and position of the supply screw 61 are designed so that the target amount is obtained.

When the control unit 110 performs the toner supply to the developing device 33, it does not continuously rotate the supply screw 61 but repeats rotation and stop of the supply screw 61 at a predetermined time ratio (rotates the supply screw 61 in an intermittent manner). In other words, the control unit 110 rotates the supply screw 61 for a predetermined period (a rotation period) and then stops rotation of the supply screw 61 for a predetermined period (a rotation stop period). Further, although not a limitation, in an initial setting, the time ratio is set so that a rotation period ratio of the supply screw 61 becomes smaller than a rotation stop period ratio.

In addition, the control unit 110 is connected to a reader/writer 140. This reader/writer 140 is used for writing data in an IC tag 201 (corresponding to a "container memory unit") provided to the container 200 and reading data from the IC tag 201.

The control unit 110 writes (updates) use history information of the container 200 in the IC tag 201 via the reader/writer 140. Note that a type of information to be written as the use history information in the IC tag 201 is not limited to a particular type. For instance, the control unit 110 writes printed sheet number information (the use history information) indicating an accumulated value of the number of printed sheets after the container 200 is mounted in the image forming apparatus 100.

Alternatively, the control unit 110 writes in the IC tag 201 toner supply amount information (use history information) indicating an accumulated value of a toner supply amount after the container 200 is mounted in the image forming apparatus 100. Note that the supply screw 61 supplies a substantially fixed amount of toner per one rotation to the developing device 33. In other words, a drop amount of toner per one rotation of the supply screw 61 is substantially constant. Accordingly, the toner supply amount from the container 200 to the developing device 33 can be obtained on the basis of the number of rotation of the supply screw 61.

For instance, the control unit 110 reads the toner supply amount information from the IC tag 201 of the container 200 currently mounted in the image forming apparatus 100, and recognizes a remaining amount of the toner in the container 200 on the basis of the toner supply amount information. Further, the control unit 110 controls the operation panel 108 to display an indicator that indicates a toner remaining amount of the container 200, for example.

This IC tag 201 stores identification information of the corresponding container 200 in advance. Further, when the container 200 is mounted in the image forming apparatus 100, the control unit 110 reads the identification information from the IC tag 201 of the container 200 and recognizes the container 200 mounted in the image forming apparatus 100. For instance, the control unit 110 determines whether or not the container 200 is replaced on the basis of the identification information stored in the IC tag 201. Note that the determination whether or not the container 200 is replaced can also be performed on the basis of the use history information.

In addition, the control unit 110 is connected to a cover sensor 150 whose output value is changed in response to opening/closing of the cover 100C (see FIG. 1). The control unit 110 detects opening/closing of the cover 100C on the basis of the output value of this cover sensor 150.

<Notification for Urging Replacement of Container>

In this embodiment, in order to maintain the amount of toner in the developing device 33 at the first reference amount, the toner is supplied from the container 200 to the developing device 33 when the amount of toner in the developing device 33 becomes smaller than the first reference amount. In this case, if there is sufficient amount of toner remaining in the container 200, the amount of toner in the developing device 33 returns to the first reference amount or more by the toner supply.

However, if there is little toner in the container 200 (if the amount of the toner dropping from the container 200 is little when the supply screw 61 rotates), the amount of toner in the developing device 33 does not return to the first reference amount or more after the toner supply is performed. In this case, it is necessary to replace the container 200 currently mounted in the image forming apparatus 100 with another container 200 (a new container 200).

Accordingly, if the amount of toner in the developing device 33 does not return to the first reference amount or more and the amount of toner in the developing device 33 is less than a predetermined second reference amount that is less than the first reference amount (but a little more than an empty state) after the toner supply is performed, the control unit 110 determines that the amount of toner in the container 200 has become a toner low state that requires replacement of the container 200. Further, when the control unit 110 determines that the toner low state has occurred, it performs a process for urging the user to replace the container 200 currently mounted in the image forming apparatus 100 with another container 200 (a new container 200).

For instance, when the control unit 110 determines that the toner low state has occurred, it controls the operation panel 108 to make a replacement notification for urging the user to replace the container 200. Note that the operation panel 108 corresponds to a "notifying unit" in this structure.

Figure 4:
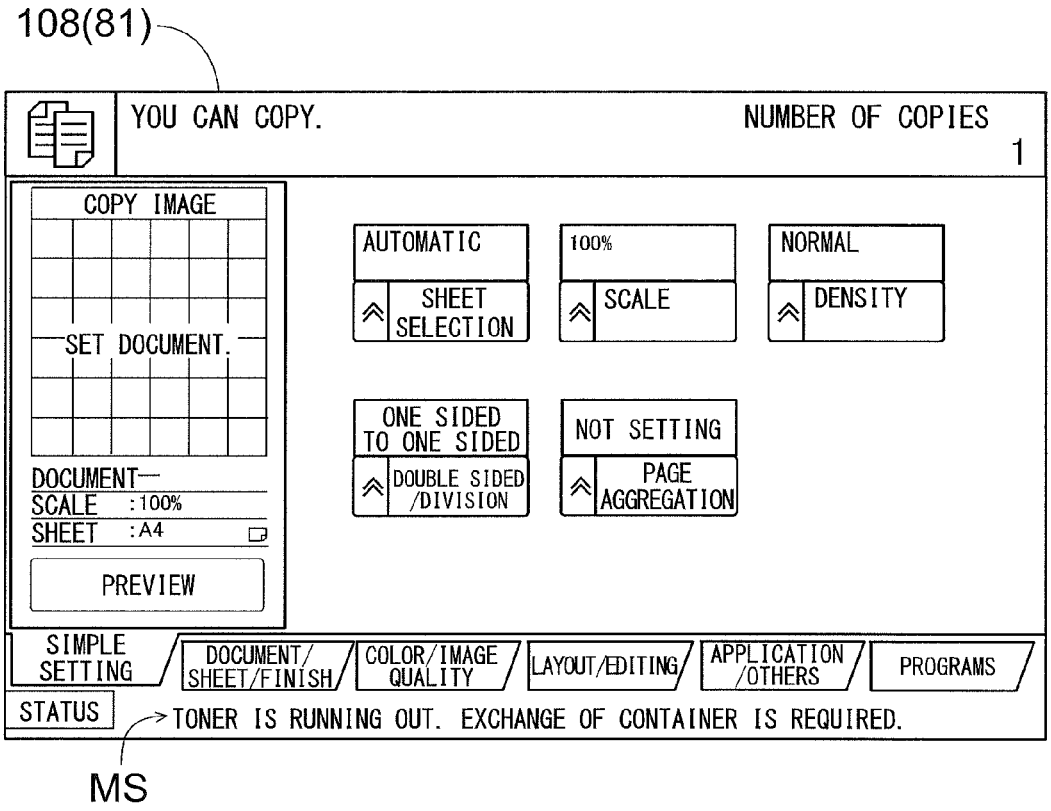
FIG. 4 is a diagram illustrating an example of a notification message (urging replacement of the container) displayed on an operation panel of the image forming apparatus according to an embodiment of the present disclosure.

When the operation panel 108 makes the replacement notification, it displays a notification message MS for urging the user to replace the container 200 as illustrated in FIG. 4. For instance, the notification message MS is displayed in an area of a screen that is currently displayed (an area that is determined in advance as a display area of the notification message MS). Alternatively, although not illustrated, it is possible to display a dialog box with the notification message MS in a pop-up manner.

Note that even in the toner low state, it is possible to perform printing if there is toner remaining in the developing device 33. Accordingly, the user may continue the printing in the toner low state without replacing the container 200 although the notification message MS is made. In this case, the amount of the toner in the developing device 33 becomes very small at last, and hence image quality of a printed image becomes very bad.

Accordingly, after the control unit 110 determines that the toner low state has occurred, when the number of printed sheets reaches a predetermined number without canceling the toner low state, the control unit 110 determines that the amount of toner in the developing device 33 is in the empty state. Alternatively, after the control unit 110 determines that the toner low state has occurred, when the number of printed dots (the number of dots on which the toner is placed) reaches a predetermined number of dots without canceling the toner low state, the control unit 110 determines that the amount of toner in the developing device 33 is in the empty state.

When the control unit 110 determines that the developing device 33 is in the empty state, it stops execution of the print job although it is being executed. Further, although not illustrated, the control unit 110 controls the operation panel 108 to display an error message indicating that the developing device 33 is in the empty state (message urging the user to replace the container 200). This error message is displayed until the container 200 is replaced. Note that while the error message is displayed on the operation panel 108, the printing job cannot be executed.

<False Detection in Detecting Whether or not Toner Low State has Occurred>

For instance, even if a sufficient amount of toner remains in the container 200, if the toner gathers in a part of the container 200 (the toner is biased to a part of the container 200), the drop amount of toner per one rotation of the supply screw 61 (the amount of toner supplied to the developing device 33 when the supply screw 61 rotates one turn) may be smaller than the target amount.

In this case, even if the toner supply is performed when the amount of toner in the developing device 33 becomes smaller than the first reference amount, the amount of toner in the developing device 33 may not return to the first reference amount or more but is smaller than the second reference amount. As a result, although there is a sufficient amount of toner remaining in the container 200, the control unit 110 determines that the toner low state has occurred (a false detection occurs in detecting whether or not the toner low state has occurred).

In addition, even if there is a sufficient amount of toner remaining in the container 200, when high density printing that consumes a large amount of toner per unit time is executed, the toner supply to the developing device 33 cannot keep up with toner consumption in the developing device 33. Then, the amount of toner in the developing device 33 may be less than the second reference amount. In this case too, as a result, although there is a sufficient amount of toner remaining in the container 200, the control unit 110 determines that the toner low state has occurred (a false detection occurs in detecting whether or not the toner low state has occurred).

When the control unit 110 determines that the toner low state has occurred, although there is a sufficient amount of toner remaining in the container 200, the operation panel 108 displays the notification message MS (see FIG. 4). Further, the user who checks this notification message MS will replace the container 200. In other words, the user opens the cover 100C (see FIG. 1) and detaches the container 200 from the image forming apparatus 100.

In this case, if there is a sufficient amount of toner remaining in the container 200, it is necessary to attach again the once detached container 200 to the image forming apparatus 100 and to return the cover 100C from an opened state to a closed state. For instance, the user sees the indicator indicating the toner remaining amount displayed on the operation panel 108 and checks that there is a sufficient amount of toner remaining in the container 200. Alternatively, the user weighs the container 200 detached from the image forming apparatus 100 when holding it, and checks that there is a sufficient amount of toner remaining in the container 200.

Further, the user may check that there is a sufficient amount of toner remaining in the container 200 by seeing the indicator indicating the toner remaining amount displayed on the operation panel 108 before detaching the container 200 from the image forming apparatus 100. In this case, the user may restart the image forming apparatus 100 (may turn off and on a main power of the image forming apparatus 100) in order to cancel the display of the notification message MS.

The control unit 110 performs a warm-up operation when the cover 100C changes from the opened state to the closed state after determining that the toner low state has occurred. In addition, the control unit 110 performs the warm-up operation also when the image forming apparatus 100 is restarted after determining that the toner low state has occurred. Note that in the warm-up operation, the toner supply from the container 200 to the developing device 33 is performed until the amount of toner in the developing device 33 becomes the first reference amount or more. Even if the container 200 is not replaced, if there is a sufficient amount of toner remaining in the container 200, the amount of toner in the developing device 33 returns to the first reference amount or more as a result of the warm-up operation that is performed this time. In other words, if the amount of toner in the developing device 33 returns to the first reference amount or more without replacement of the container 200, it means that a false detection has occurred in detecting whether or not the toner low state has occurred.

In this way, if the control unit 110 determines that the toner low state has occurred although there is a sufficient amount of toner remaining in the container 200 (if a false detection has occurred in detecting whether or not the toner low state has occurred), the user is forced to do unnecessary work (open and close the cover 100C, detach and attach the container 200, and restart the image forming apparatus 100).

In addition, when the user performs the work so as to perform the warm-up operation, the image forming apparatus 100 cannot be used during the warm-up operation. Accordingly, if the false detection occurs, it bothers the user.

<False Detection Suppression Process>

(Outline)

In this embodiment, when a false detection occurs in detecting whether or not the toner low state has occurred, a false detection suppression process is performed for suppressing occurrence of another false detection afterward. Note that the false detection suppression process includes a first process and a second process.

Specifically, the control unit 110 determines whether or not the false detection has occurred (determines whether or not the amount of toner in the developing device 33 has returned to the first reference amount or more without replacement of the container 200). Further, when the control unit 110 determines that the false detection has occurred, it controls the IC tag 201 of the container 200 currently mounted in the image forming apparatus 100 to store predetermined information (indicating that the toner low state is canceled).

In addition, when the control unit 110 performs the toner supply, it makes access to the IC tag 201 of the container 200 currently mounted in the image forming apparatus 100, so as to check whether or not the predetermined information is stored. Then, if the predetermined information is stored in the IC tag 201, the control unit 110 performs the false detection suppression process.

Further, if the predetermined information is not stored in the IC tag 201, it means that the false detection has not occurred. Accordingly, in this case, it is not necessary to perform the false detection suppression process (the first process and the second process). Accordingly, when the control unit 110 performs the toner supply, if the predetermined information is not stored in the IC tag 201 of the container 200 currently mounted in the image forming apparatus 100, the control unit 110 does not perform the false detection suppression process. In this way, it is possible to prevent the false detection suppression process from being unnecessarily performed.

(Storing of Predetermined Information in IC Tag)

Hereinafter, with reference to a flowchart illustrated in FIG. 5, a flow of control when storing the predetermined information in the IC tag 201 is described.

Figure 5:
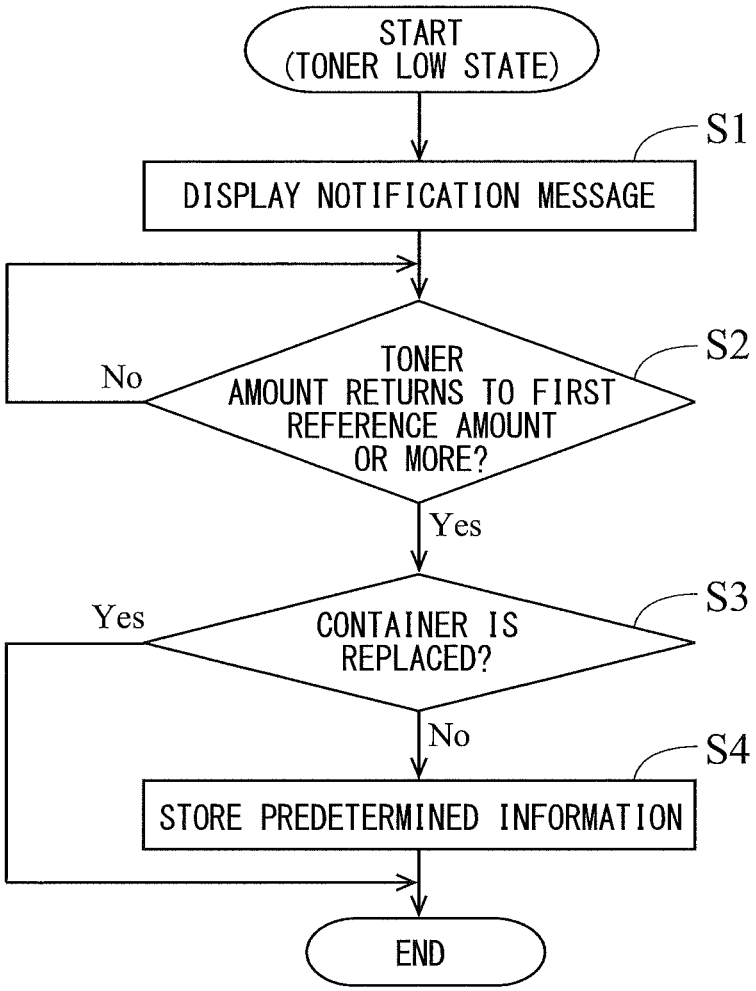
FIG. 5 is a flowchart for explaining a flow of control when storing predetermined information in an IC tag of the container mounted in the image forming apparatus according to an embodiment of the present disclosure.

Note that it is supposed that the predetermined information is not stored in the IC tag 201 of the container 200 currently mounted in the image forming apparatus 100 at the start point time of the flowchart illustrated in FIG. 5. Further, the flowchart illustrated in FIG. 5 starts when the control unit 110 determines that the toner low state has occurred. In other words, the flowchart illustrated in FIG. 5 starts when the amount of toner in the developing device 33 becomes less than the second reference amount.

In Step S1, the control unit 110 controls the operation panel 108 to display the notification message MS (see FIG. 4). In addition, in Step S2, the control unit 110 determines whether or not the amount of toner in the developing device 33 has returned to the first reference amount or more on the basis of the output value of the toner sensor 130. As a result of this determination, the process proceeds to Step S3 if the amount of toner in the developing device 33 has returned to the first reference amount or more, while the determination in Step S2 is repeated if the amount of toner has not returned to the same.

When proceeding to Step S3, the control unit 110 determines whether or not the container 200 that was mounted in the image forming apparatus 100 when the toner low state had occurred is replaced with another container 200 (a new container 200), on the basis of the container information stored in the IC tag 201 of the container 200 currently mounted in the image forming apparatus 100. If the container 200 is not replaced as a result of this determination, the process proceeds to Step S4.

When the process proceeds to Step S4, the control unit 110 controls the IC tag 201 of the container 200 currently mounted in the image forming apparatus 100 to store the predetermined information. In other words, when the control unit 110 detects that the amount of toner in the developing device 33 has returned to the first reference amount or more without replacement of the container 200, the control unit 110 determines that a false detection has occurred and controls the IC tag 201 of the container 200 currently mounted in the image forming apparatus 100 to store the predetermined information. The container 200 to be the target in this case is the same as the container 200 that was mounted in the image forming apparatus 100 when the toner low state had occurred.

(Execution of False Detection Suppression Process)

As the false detection suppression process, there are the first process and the second process. Which one of the first process and the second process should be actually performed as the false detection suppression process is not limited in particular. In other words, only the first process may be performed, or only the second process may be performed. Alternatively, both the first process and the second process may be performed.

First, when the first process is performed, the control unit 110 changes a time ratio between rotation and stop of the supply screw 61 so as to increase the rotation period ratio of the supply screw 61 to be larger than that when it was determined that the toner low state had occurred.

For instance, the control unit 110 changes the time ratio so that the rotation period ratio becomes larger than the rotation stop period ratio of the supply screw 61. Further, in an initial setting, the time ratio is set so that the rotation period ratio is smaller than the rotation stop period ratio of the supply screw 61. In this way, the toner supply amount by the supply screw 61 from the container 200 to the developing device 33 per unit time is increased.

Figure 6:
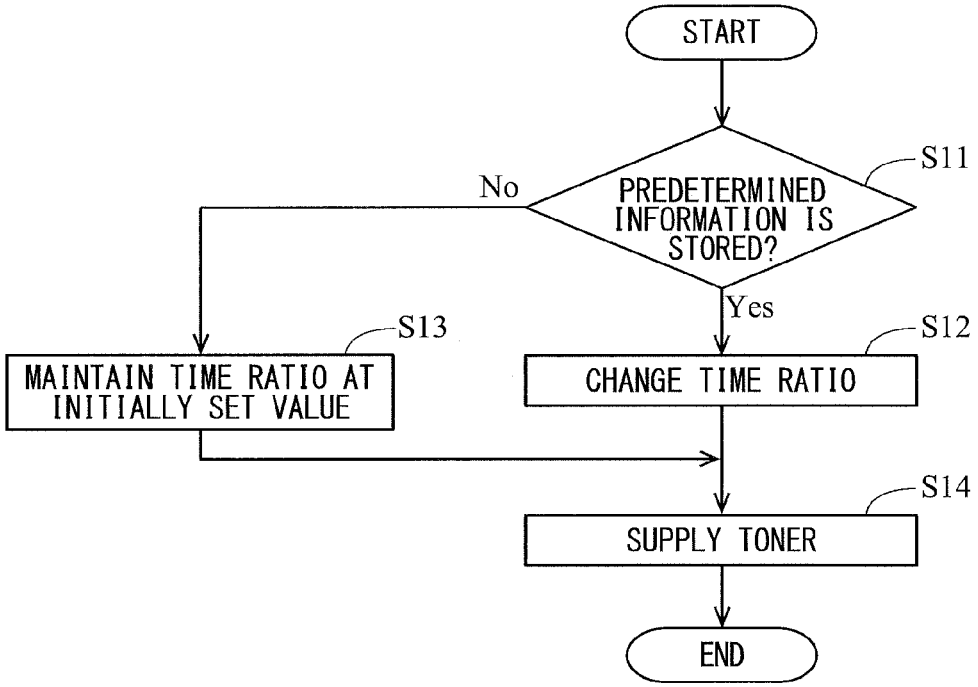
FIG. 6 is a flowchart for explaining a flow of control when performing a first process in the image forming apparatus according to an embodiment of the present disclosure.

Hereinafter, with reference to a flowchart illustrated in FIG. 6, a flow of control when performing the first process is described. Further, the flowchart illustrated in FIG. 6 starts when the toner supply is started in the printing job, and when the amount of toner in the developing device 33 becomes smaller than the first reference amount.

In Step S11, the control unit 110 makes access to the IC tag 201 of the container 200 currently mounted in the image forming apparatus 100 and determines whether or not the predetermined information is stored. As a result of this determination, if the predetermined information is stored in the IC tag 201, the process proceeds to Step S12. If the predetermined information is not stored in the IC tag 201, the process proceeds to Step S13.

When the process proceeds to Step S12, the control unit 110 performs the first process. In other words, the control unit 110 changes the time ratio so that the rotation period ratio becomes larger than the rotation stop period ratio of the supply screw 61. After that, the process proceeds to Step S14, and the control unit 110 performs the toner supply. In this case, the control unit 110 performs the toner supply with the changed time ratio. Further, when the container 200 is replaced after changing the time ratio between rotation and stop of the supply screw 61, the control unit 110 returns the changed time ratio to the initially set time ratio.

On the other hand, when the process proceeds to Step S13, the control unit 110 does not perform the first process. In other words, the control unit 110 maintains the time ratio between the rotation period and the rotation stop period of the supply screw 61 at the initially set value. After that, the process proceeds to Step S14, and the control unit 110 performs the toner supply. In this case, the control unit 110 performs the toner supply with the initially set time ratio.

Next, when performing the second process, the control unit 110 changes the first reference amount so that the first reference amount (an appropriate amount of toner to be stored in the developing device 33) becomes larger than the amount when it was determined that the toner low state had occurred. When the first reference amount is changed in this way, the amount of toner stored in the developing device 33 is increased (the toner supply is started in a state where the remaining amount of toner in the developing device 33 is larger than before).

Figure 7:
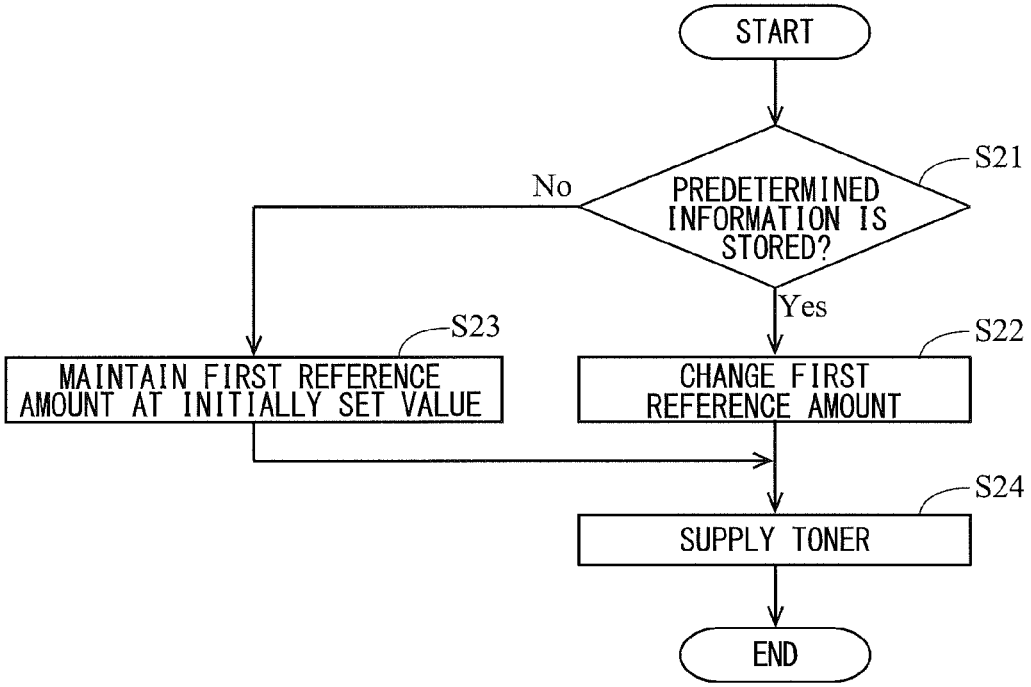
FIG. 7 is a flowchart for explaining a flow of control when performing a second process in the image forming apparatus according to an embodiment of the present disclosure.

Hereinafter, with reference to a flowchart illustrated in FIG. 7, a flow of control when performing the second process is described. Note that the flowchart illustrated in FIG. 7 starts when the toner supply is started in the printing job, and when the amount of toner in the developing device 33 becomes smaller than the first reference amount.

In Step S21, the control unit 110 makes access to the IC tag 201 of the container 200 currently mounted in the image forming apparatus 100 and determines whether or not the predetermined information is stored. As a result of this determination, if the predetermined information is stored in the IC tag 201, the process proceeds to Step S22. If the predetermined information is not stored in the IC tag 201, the process proceeds to Step S23.

When the process proceeds to Step S22, the control unit 110 performs the second process. In other words, the control unit 110 changes the first reference amount so that the first reference amount is increased. After that, the process proceeds to Step S24, and the control unit 110 performs the toner supply. In this case, the control unit 110 performs the toner supply until the amount of toner in the developing device 33 becomes the changed first reference amount. Further, when the container 200 is replaced after the first reference amount is changed, the control unit 110 returns the first reference amount to the initially set first reference amount.

On the other hand, when the process proceeds to Step S23, the control unit 110 does not perform the second process. In other words, the control unit 110 maintains the first reference amount at the initially set value. After that, the process proceeds to Step S24, and the control unit 110 performs the toner supply. In this case, the control unit 110 performs the toner supply until the amount of toner in the developing device 33 becomes the initially set first reference amount.

The image forming apparatus 100 of this embodiment includes, as described above, the developing device 33 that stores toner and supplies the toner to an electrostatic latent image formed on the photosensitive drum 31 (image carrier) so as to develop the electrostatic latent image into a toner image, the container 200 that is replaceable with respect to the image forming apparatus 100 and stores supply toner to be supplied to the developing device 33, the IC tag 201 (container memory unit) that is provided to the container 200 and stores container information including identification information and use history information of the container 200, the supply screw 61 that is rotated so as to perform toner supply from the container 200 to the developing device 33, and repeats rotation and stop at a predetermined time ratio while performing the toner supply, the operation panel 108 (notifying unit) that makes a replacement notification for urging the user to replace the container 200 when a remaining amount state of toner in the container 200 becomes a predetermined toner low state (which requires replacement of the container 200), the toner sensor 130 for detecting an amount of toner in the developing device 33, and the control unit 110 that detects an amount of toner in the developing device 33 on the basis of an output value of the toner sensor 130, controls the supply screw 61 to perform the toner supply when the amount of toner in the developing device 33 becomes less than a predetermined first reference amount, stops the toner supply when the amount of toner in the developing device 33 returns to the first reference amount or more, and determines that the toner low state has occurred so as to control the operation panel 108 to make the replacement notification when the amount of toner in the developing device 33 does not return to the first reference amount or more but is less than a predetermined second reference amount even if the toner supply is performed. The control unit 110 determines whether or not the container 200 that was mounted in the image forming apparatus 100 when the toner low state had occurred is replaced with another container 200 on the basis of the container information after determining that the toner low state had occurred, and controls the IC tag 201 to store predetermined information indicating that the toner low state is canceled when detecting that the amount of toner in the developing device 33 has returned to the first reference amount or more without replacement of the container 200. In addition, the control unit 110 performs at least one of a first process and a second process if the predetermined information is stored in the IC tag 201 of the container 200 currently mounted in the image forming apparatus 100 when performing the toner supply. The first process is a process of changing the time ratio so that the rotation period ratio of the supply screw 61 becomes larger than that set when determining that the toner low state had occurred. The second process is a process of changing the first reference amount (an appropriate amount of toner to be stored in the developing device 33) so that the first reference amount becomes larger than that set when determining that the toner low state had occurred.

In the structure of this embodiment, when the amount of toner in the developing device 33 returns to the first reference amount or more without replacement of the container 200 after the toner low state occurs (after the amount of toner in the developing device 33 becomes less than the second reference amount), the predetermined information is stored in the IC tag 201 of the container 200 currently mounted in the image forming apparatus 100.

Here, if the amount of toner in the developing device 33 returns to the first reference amount or more without replacement of the container 200 after the toner low state occurs, it means that there was a sufficient amount of toner remaining in the container 200 that was mounted in the image forming apparatus 100 when the toner low state had occurred, and that a false detection occurred in detecting whether or not a toner low state had occurred. In other words, the process of controlling the IC tag 201 to store the predetermined information is performed when detecting that a false detection occurred in detecting whether or not a toner low state had occurred.

Note that a false detection in detecting whether or not a toner low state has occurred is generated, for example, when the toner is gathered in a part of the container 200. It is because when the toner is gathered in a part of the container 200, the drop amount of toner per one rotation of the supply screw 61 (the amount of toner supplied from the container 200 to the developing device 33 when the supply screw 61 rotates one turn) becomes smaller than the target amount, and hence the toner supply to the developing device 33 cannot keep up with toner consumption in the developing device 33. In addition, the phenomenon that the toner supply to the developing device 33 cannot keep up with toner consumption in the developing device 33 can be generated also when the high density printing that consumes a large amount of toner per unit time is executed, even if the toner is not gathered in a part of the container 200.

Accordingly, in the structure of this embodiment, at least one of the first process and the second process is performed, if the predetermined information is stored in the IC tag 201 of the container 200 currently mounted in the image forming apparatus 100 when the toner supply is performed. When the first process is performed, the toner supply amount by the supply screw 61 from the container 200 to the developing device 33 per unit time is increased, and hence it is possible to suppress occurrence of malfunction in which the amount of toner in the developing device 33 is decreased to the second reference amount (that is determined to be the toner low state) although there is a sufficient amount of toner remaining in the container 200.

For instance, when the first process is performed, the time ratio is changed so that the rotation period ratio becomes larger than the rotation stop period ratio of the supply screw 61. In this way, it is more difficult that the amount of toner in the developing device 33 is deceased to the second reference amount.

When the second process is performed, the amount of toner stored in the developing device 33 is increased (the toner supply is started when the remaining amount state of toner in the developing device 33 is more than before). Accordingly, it is possible to suppress occurrence of malfunction in which the amount of toner in the developing device 33 is decreased to the second reference amount (that is determined to be the toner low state) although there is a sufficient amount of toner remaining in the container 200.

In this way, when at least one of the first process and the second process is performed, it is possible to suppress occurrence of another false detection after a false detection once occurs in detecting whether or not a toner low state has occurred. In addition, it is possible to prevent an unnecessary warming-up operation from being performed. Furthermore, it is possible to prevent that an impression of low accuracy in detecting the amount of toner is given to the user.

Further, when the second process is performed, the amount of toner remaining in the developing device 33 without being consumed becomes large. An electric stress or a physical stress is repeatedly applied to the toner in the developing device 33. Accordingly, a ratio of deteriorated toner in the developing device 33 becomes high. For this reason, it is preferred to perform only the first process as the false detection suppression process out of the first process and the second process.

Here, a false detection may occur after only the first process is performed. Accordingly, it is possible to adopt a structure in which the second process is further performed if a false detection occurs after the first process is performed.

In this structure, for example, if the toner low state occurs in the toner supply after only the first process is performed, and then the amount of toner in the developing device 33 returns to the first reference amount or more without replacement of the container 200, the control unit 110 overwrites information indicating the fact as new predetermined information in the IC tag 201 of the container 200 currently mounted in the image forming apparatus 100. Further, when the control unit 110 performs the toner supply after that, if the new predetermined information is stored in the IC tag 201 of the container 200 currently mounted in the image forming apparatus 100, the control unit 110 performs the second process while maintaining the time ratio changed in the first process.

In this way, if a false detection occurs after the first process is performed, the second process is further performed, and thus it is possible to suppress occurrence of a false detection after that.

The embodiment disclosed in this specification is merely an example in every aspect and should not be interpreted as a limitation. The scope of the present disclosure is defined not by the above description of the embodiment but by the claims, which should be interpreted to include all modifications within the claims and equivalent meanings and scope thereof.

What is claimed is:

1. An image forming apparatus comprising:

a developing device for storing toner and supplying the toner to an electrostatic latent image formed on an image carrier so as to develop the electrostatic latent image into a toner image;

a container for storing supply toner to be supplied to the developing device, the container being replaceable with respect to the image forming apparatus;

a container memory unit provided to the container, for storing container information including identification information and use history information of the container;

a supply screw for performing toner supply from the container to the developing device by rotating, the supply screw repeating rotation and stop at a predetermined time ratio while performing the toner supply;

a notifying unit configured to make a replacement notification for urging a user to replace the container when a remaining amount state of toner in the container becomes a predetermined toner low state;

a toner sensor for detecting an amount of toner in the developing device; and a control unit configured to detect an amount of toner in the developing device on the basis of an output value of the toner sensor, to control the supply screw to perform the toner supply when the amount of toner in the developing device becomes less than a predetermined first reference amount, to stop the toner supply when the amount of toner in the developing device returns to the first reference amount or more, and to determine that the toner low state has occurred so as to control the notifying unit to make the replacement notification when the amount of toner in the developing device does not return to the first reference amount or more but is less than a predetermined second reference amount after performing the toner supply, wherein the control unit determines whether or not the container that was mounted in the image forming apparatus when the toner low state had occurred is replaced with another container on the basis of the container information after determining the toner low state had occurred, and controls the container memory unit to store predetermined information indicating that the toner low state is canceled when detecting that the amount of toner in the developing device has returned to the first reference amount or more without replacement of the container, and the control unit performs at least one of a first process and a second process if the predetermined information is stored in the container memory unit of the container currently mounted in the image forming apparatus when performing the toner supply, the first process being a process of changing the time ratio so that a rotation period ratio of the supply screw becomes larger than that set when determining that the toner low state had occurred, and the second process being a process of changing the first reference amount so that the first reference amount becomes larger than that set when determining that the toner low state had occurred.

2. The image forming apparatus according to claim 1, wherein the control unit performs only the first process out of the first process and the second process.

3. The image forming apparatus according to claim 2, wherein the control unit performs the second process while maintaining the time ratio changed by the first process when performing the toner supply if the toner low state occurs in the toner supply after only the first process is performed, and then the amount of toner in the developing device returns to the first reference amount or more without replacement of the container.

4. The image forming apparatus according to claim 1, wherein the control unit does not perform the first process and the second process if the predetermined information is not stored in the container memory unit of the container currently mounted in the image forming apparatus when performing the toner supply.

5. The image forming apparatus according to claim 1, wherein the time ratio is set so that a rotation period ratio becomes smaller than a rotation stop period ratio of the supply screw in an initial setting, and the control unit changes the time ratio so that the rotation period ratio becomes larger than the rotation stop period ratio of the supply screw by performing the first process.

* * * * *